US011767093B2

(12) United States Patent
Inoue

(10) Patent No.: US 11,767,093 B2
(45) Date of Patent: Sep. 26, 2023

(54) CONTROL DEVICE OF MARINE PROPULSION DEVICE, CONTROL METHOD THEREOF, AND MARINE VESSEL

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 529 days.

(21) Appl. No.: 17/100,499

(22) Filed: Nov. 20, 2020

(65) Prior Publication Data

US 2021/0197943 A1 Jul. 1, 2021

(30) Foreign Application Priority Data

Dec. 27, 2019 (JP) ..... 2019-238342

(51) Int. Cl.
*B63H 21/21* (2006.01)
*B63H 1/14* (2006.01)

(52) U.S. Cl.
CPC ..... *B63H 21/21* (2013.01); *B63H 1/14* (2013.01); *B63H 2021/216* (2013.01)

(58) Field of Classification Search
CPC .... B63H 21/21; B63H 1/14; B63H 2021/216; B63H 20/12; B63B 39/061
See application file for complete search history.

(56) References Cited

U.S. PATENT DOCUMENTS

| | | | | |
|---|---|---|---|---|
| 9,545,987 | B1 * | 1/2017 | Przybyl | B63H 21/21 |
| 10,766,592 | B1 * | 9/2020 | Przybyl | F16H 61/68 |
| 11,679,853 | B2 * | 6/2023 | Wong | B63B 39/14 701/21 |
| 2006/0057910 | A1 * | 3/2006 | Stallings | B63H 20/08 440/79 |
| 2020/0108902 | A1 * | 4/2020 | Wong | B63H 20/10 |

FOREIGN PATENT DOCUMENTS

| | | |
|---|---|---|
| JP | 2004124816 A | 4/2004 |
| JP | 2006077642 A | 3/2006 |

* cited by examiner

*Primary Examiner* — Richard M Camby
(74) *Attorney, Agent, or Firm* — Rabin & Berdo, P.C.

(57) ABSTRACT

A control device of a marine propulsion device, which has an engine and a propeller and is mounted on a hull. The control device includes a processor, and a non-transitory storage medium having program instructions stored thereon. The execution of the program instructions by the processor causes the control device to acquire a rotation speed of the engine or a rotation speed of the propeller, acquire a torque of the engine, acquire a speed of the hull, and determine whether a ventilation of the engine has occurred based on at least two among the acquired rotation speed, the acquired engine torque, and the acquired hull speed.

11 Claims, 6 Drawing Sheets

CONTROL DEVICE OF MARINE PROPULSION DEVICE, CONTROL METHOD THEREOF, AND MARINE VESSEL

CROSS REFERENCE TO RELATED APPLICATIONS

This application claims the benefit of Japanese Patent Application No. 2019-238342, filed Dec. 27, 2019, which is hereby incorporated by reference wherein in its entirety.

BACKGROUND OF THE INVENTION

1. Field of the Invention

The present invention relates to a control device of a marine propulsion device having an engine and a propeller, a control method thereof, and a marine vessel including the marine propulsion device.

2. Description of the Related Art

In the related art, a device that controls the engine rotation speed (rpm) has been known as a control device of a marine propulsion device having an engine and a propeller (Japanese Laid-open Patent Publication (Kokai) No. 2006-77642). Japanese Laid-open Patent Publication (Kokai) No. 2006-77642 discloses that a technique of determining the occurrence of over-rotation (ventilation) of the engine from the target rpm of the engine and actual rpm of the engine, and decreasing the throttle opening when it has become over-rotated.

However, the likeliness to the occurrence of ventilation also changes depending on the hull speed, the throttle operation, and the like. The ventilation is likely to occur especially when the hull is going to be accelerated. Thus, the ventilation cannot be accurately determined merely by the target rpm and the actual rpm. Therefore, there was room for improvement in terms of accurately determining the occurrence of ventilation.

SUMMARY OF THE INVENTION

An object of the present invention is to accurately determine whether ventilation has occurred.

According to a preferred embodiment of the present invention, a control device of a marine propulsion device having an engine and a propeller, the control device comprising: a memory storing a program; and a controller configured to execute the program stored in the memory to acquire an rpm of the engine or an rpm of the propeller, acquire an engine torque, acquire a speed of a hull equipped with the marine propulsion device, and determine whether ventilation has occurred based on at least two of the acquired rpm, the acquired engine torque, and the acquired hull speed.

According to this configuration, an engine rpm or a propeller rpm is acquired, an engine torque is acquired, a speed of the hull equipped with the marine propulsion device is acquired, and whether ventilation has occurred is determined based on the acquired rpm, the acquired engine torque, and the acquired hull speed.

Further features of the present invention will become apparent from the following description of exemplary embodiments with reference to the attached drawings.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
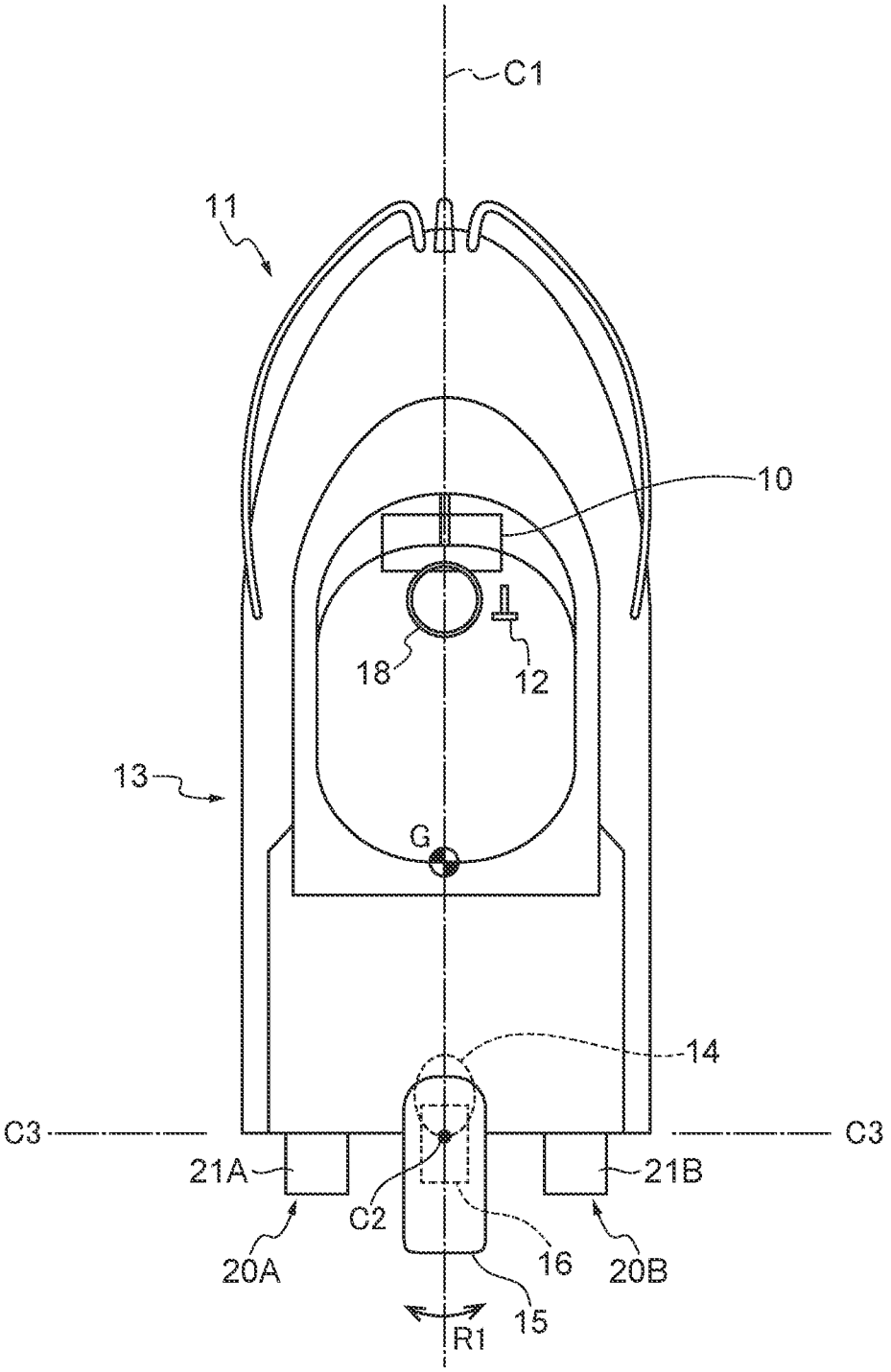
FIG. 1 is a top view of a marine vessel to which a control device of a marine propulsion device is applied.

FIG. 1 is a top view of a marine vessel 11 to which a control device of a marine propulsion device according to an embodiment of the present invention is applied. The marine vessel 11 includes a hull 13, an outboard motor 15 as a marine propulsion device mounted on the hull 13, and a plurality (for example, a pair) of trim tabs 20. A central unit 10, a steering wheel 18, and a throttle lever 12 are provided in the vicinity of a cockpit in the hull 13.

In the following description, a fore-and-aft direction, a crosswise direction, and a vertical direction mean a fore- and aft direction, a crosswise direction, and a vertical direction, respectively, of the hull 13. For example, as shown in FIG. 1, a centerline C1 extending in the fore-and-aft direction of the hull 13 passes through the center of gravity G of the marine vessel 11. The fore-and-aft direction is the direction along the centerline C1. Fore or front means a direction toward the upper side of FIG. 1 along the centerline C1. Aft or rear means a direction toward the lower side of FIG. 1 along the centerline C1. The crosswise direction is defined based on a direction when the hull 13 is viewed from the rear. The vertical direction is a direction vertical to the fore-and-aft direction and the crosswise direction.

The outboard motor 15 is mounted on the hull 13. The outboard motor 15 is mounted on the hull 13 via a mounting unit 14. The outboard motor 15 has an engine 16 which is an internal combustion engine. The outboard motor 15 obtains a propulsive force to move the hull 13 by a propeller 28 (FIG. 2) rotated by the driving force of the engine 16.

Figure 3:
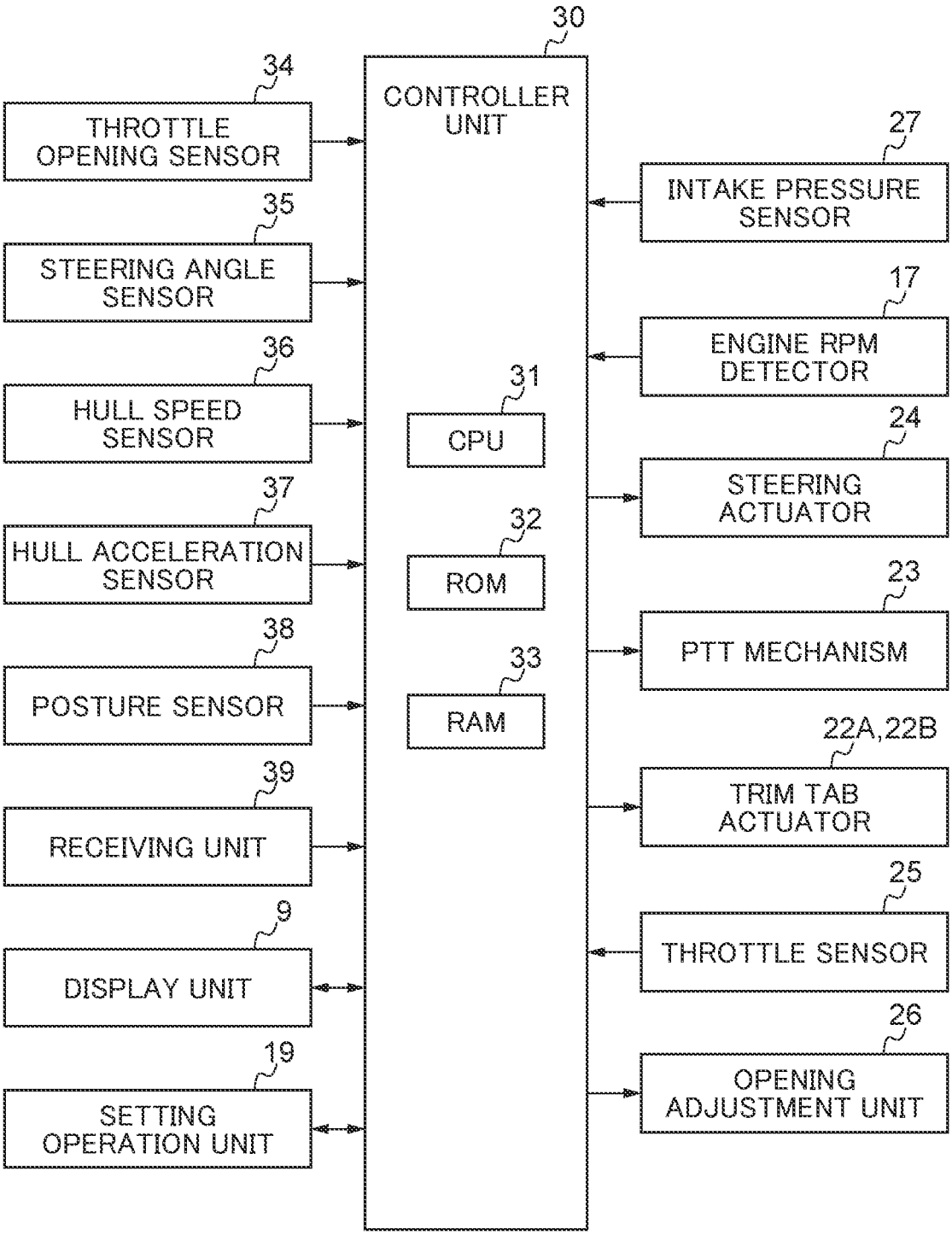
FIG. 3 is a block diagram of a marine vessel maneuvering system.

The mounting unit 14 includes a swivel bracket, a clamp bracket, a steering shaft and a tilt shaft (none of them is shown). The mounting unit 14 further includes a power trim and tilt mechanism (PTT mechanism) 23 (FIG. 3). The PTT mechanism 23 turns the outboard motor 15 about the tilt shaft. This makes it possible to change an inclination angle (trim angle, tilt angle) of the outboard motor 15 with respect to the hull 13, and hence a trim adjustment can be made, and the outboard motor 15 can be tilted up and down. Further, the outboard motor 15 is turnable about a center of turn C2 (about the steering shaft) with respect to the swivel bracket. By operating the steering wheel 18, the outboard motor 15 is turned about the center of turn C2 in the crosswise direction (R1 direction). Thus, the marine vessel 11 is steered.

The pair of trim tabs 20 is attached to the port side and starboard side at the stern. To distinguish the two trim tabs 20 from each other, the one disposed on the port side is referred to as a "trim tab 20A", and the other disposed on the starboard side is referred to as a "trim tab 20B". The trim tabs 20A and 20B have a tab 21A and a tab 21B, respectively. The tabs 21A and 21B are attached to a rear portion of the hull 13 swingably around a swing axis C3. The tabs 21A and 21B are an example of a posture control tab that controls the posture of the hull 13.

Figure 2:
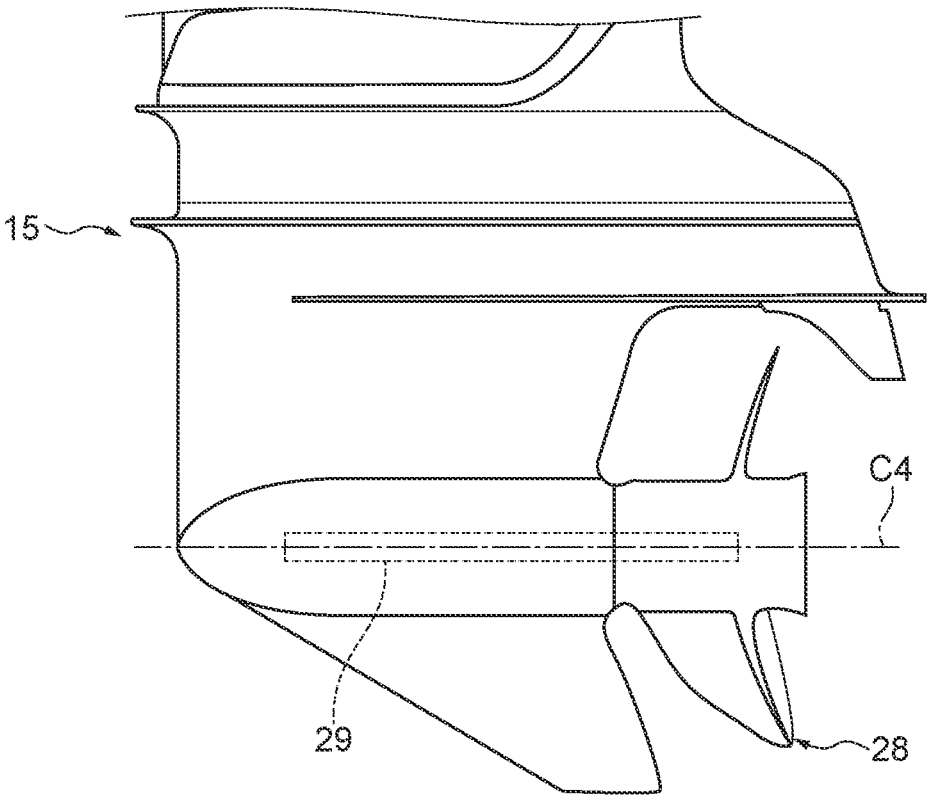
FIG. 2 is a side view of a lower portion of an outboard motor.

FIG. 2 is a side view of the lower portion of the outboard motor 15. The engine 16 gives a rotational driving force to a propeller shaft 29 via a gear (not shown), which causes the propeller 28 to rotate around a rotation center C4.

FIG. 3 is a block diagram of a marine vessel maneuvering system. The marine vessel maneuvering system includes the control device for the marine propulsion device according to the present preferred embodiment. The marine vessel 11 includes a controller unit 30, a throttle opening sensor 34, a steering angle sensor 35, a hull speed sensor 36, a hull acceleration sensor 37, a posture sensor 38, a receiving unit 39, a display unit 9, and a setting operation unit 19. The marine vessel 11 also includes an intake pressure sensor 27, an engine rpm detector 17, a steering actuator 24, the PTT mechanism 23, and trim tab actuators 22A and 22B. The marine vessel 11 also includes a throttle sensor 25 and an opening adjustment unit 26 (an opening adjustment device).

The controller unit 30, the throttle sensor 25, the opening adjustment unit 26, the steering angle sensor 35, the hull speed sensor 36, the hull acceleration sensor 37, the posture sensor 38, the receiving unit 39, the display unit 9, and the setting operation unit 19 are included in the central unit 10 or disposed in the vicinity of the central unit 10. The steering actuator 24 and the PTT mechanism 23 are provided correspondingly to the outboard motor 15. The intake pressure sensor 27, the throttle opening sensor 34, and the engine rpm detector 17 are provided in the outboard motor 15. The trim tab actuators 22A and 22B are included in the trim tabs 20A and 20B, respectively.

The controller unit 30 includes a CPU 31, a ROM 32, a RAM 33 and a timer (not shown). The ROM 32 stores the control program. The CPU 31 implements various control processes by expanding the control program stored in the ROM 32 into the RAM 33 and executing the control program. The RAM 33 provides a work area for the CPU 31 to execute the control program.

The detection results of the sensors 25, 27, 34 to 38, and the engine rpm detector 17 are supplied to the controller unit 30. The throttle lever 12 is a throttle operator by which a vessel operator manually adjusts the throttle opening. The throttle sensor 25 detects the operational position of the throttle lever 12 operated. The throttle opening sensor 34 detects the opening of a throttle valve (not shown). The opening adjustment unit 26 adjusts the opening of the throttle valve. In normal control, the CPU 31 controls the opening adjustment unit 26 based on the operational position of the throttle lever 12. The operational position of the throttle lever 12 and the actual opening of the throttle valve do not always correspond to each other.

The steering angle sensor 35 detects a turn angle of the steering wheel 18 that has been turned. The hull speed sensor 36 and the hull acceleration sensor 37 detect the speed (ship speed V) and the acceleration, respectively, of the marine vessel 11 (hull 13) while it is traveling.

The posture sensor 38 includes, for example, a gyro sensor, a magnetic azimuth sensor, and the like. The controller unit 30 calculates a roll angle, a pitch angle and a yaw angle based on a signal output from the posture sensor 38. The controller unit 30 may calculate the roll angle and the pitch angle based on the signal output from the hull acceleration sensor 37. The receiving unit 39 includes a global navigation satellite systems (GNSS) receiver such as a GPS, and has a function of receiving GPS signals and various signals as positional information. A signal received by the receiving unit 39 is supplied to the CPU 31. The acceleration of the hull 13 may also be acquired from a GPS signal received by the receiving unit 39.

The intake pressure sensor 27 detects an intake pressure of an intake manifold (not shown) of the engine 16 and transmits the detected intake pressure to the controller unit 30. The engine rpm detector 17 detects the number of rotations per unit time of the engine 16 (hereinafter referred to as the engine rpm N). The display unit 9 displays various pieces of information. The setting operation unit 19 includes an operator by which a vessel operator performs operations relating to maneuvering, a PTT operation switch, a setting operator by which a vessel operator makes various settings, and an input operator by which a vessel operator inputs various instructions (none of them is shown).

The steering actuator 24 turns the outboard motor 15 about the center of turn C2 with respect to the hull 13. The turn of the outboard motor 15 about the center of turn C2 changes the direction of the rotation center C4 around the center of turn C2. Which therefore can change the direction in which the propulsive force acts on the centerline C1 of the hull 13. The PTT mechanism 23 turns the outboard motor 15 about the tilt shaft to tilt the outboard motor 15 with respect to the clamp bracket. The PTT mechanism 23 operates by a PTT operation switch being operated, for example. Thereby, the inclination angle of the outboard motor 15 with respect to the hull 13 can be changed.

The trim tab actuators 22A and 22B are controlled by the controller unit 30. For example, the controller unit 30 outputs a control signal to each of the trim tab actuators 22A and 22B to cause them operate. The operation of each of the trim tab actuators 22A and 22B as a drive unit causes the corresponding tabs 21A and 21B to swing. The actuators used for the PTT mechanism 23 and/or the trim tab actuators 22A and 22B may be either a hydraulic type or an electric type.

The controller unit 30 may acquire the result of detection by the engine rpm detector 17 via a remote control ECU (not shown). The controller unit 30 may also control the engine 16 via an outboard motor ECU (not shown) provided in the outboard motor 15.

A signal output from the posture sensor 38 is also used to detect a turning state. The signal output from the posture sensor 38 includes the yaw rate (yaw turn angular velocity) which is an angular velocity of turn around a yaw axis. Based on the yaw rate output from the posture sensor 38, the CPU 31 determines whether the traveling direction of the hull 13 is a straight traveling direction. When the yaw rate is equal to or smaller than a predetermined value, the CPU 31 determines that the traveling direction of the hull 13 is a straight traveling direction, and when the yaw rate exceeds the predetermined value, the CPU 31 determines that the traveling direction of the hull 13 is a turning direction. The CPU 31 may determine whether the traveling direction of the hull 13 has changed base on time-series data on the yaw angle acquired from the magnetic azimuth sensor of the posture sensor 38.

The CPU 31 acquires the number of rotations per unit time of the propeller 28 (hereinafter referred to as a propeller rpm PN) from the engine rpm N. The relationship between the engine rpm N and the propeller rpm PN is known from the gear ratio etc., which enables the CPU 31 to determine the propeller rpm PN from the engine rpm N. It should be noted that a sensor that detects the rpm of the propeller 28 may be provided to directly detect the propeller rpm PN.

The CPU 31 acquires an engine torque TRK. The engine torque TRK is also the load of the propeller 28. The CPU 31 acquires the engine torque TRK from the engine rpm N and the intake pressure detected by the intake pressure sensor 27. The engine torque TRK may also be acquired from the engine rpm N and an air flow meter. Alternatively, the engine torque TRK may also be acquired from the fuel injection amount of the injector (not shown) and the ignition timing of the spark plug (not shown). Here, the fuel injection amount and the ignition timing are determined by the controller unit 30 based on parameters such as the engine rpm N, the intake pressure, the throttle opening and the engine temperature, and the pre-stored driving control map. Further, the CPU 31 acquires a ship speed V from the hull speed sensor 36.

Generally, at the time such as when the hull is suddenly accelerating, so-called ventilation is likely to occur, in which the propeller is unable to grab water enough due to water bubbles and over-rotates. The determination of whether ventilation has occurred and the ventilation suppression control will be described.

Figure 4:
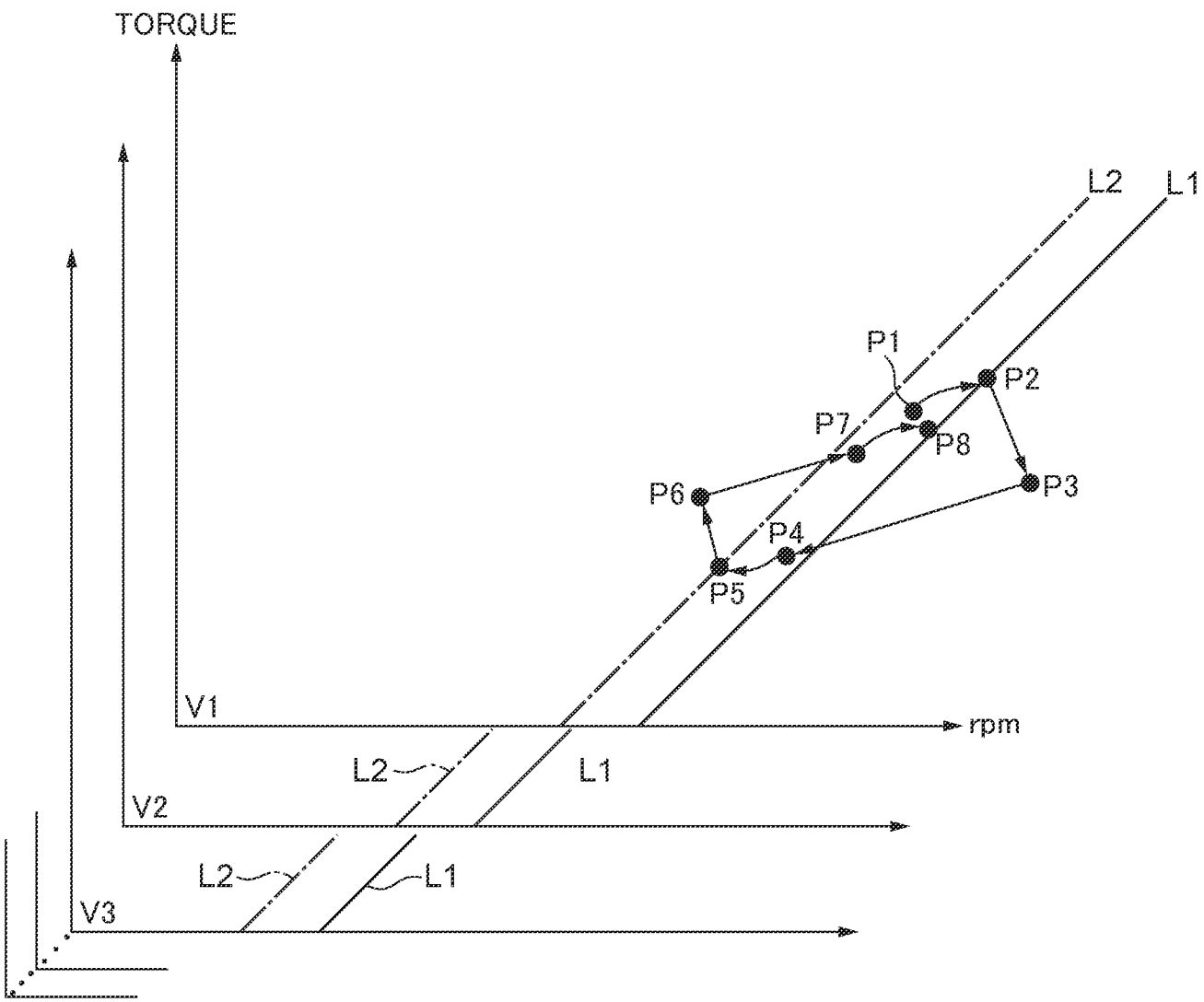
FIG. 4 is a diagram showing an example of a ventilation suppression control map.

FIG. 4 is a diagram showing an example of a ventilation suppression control map. This suppression control map is information (relationship information) that defines the relationship between the engine rpm N or the propeller rpm PN and the engine torque TRK for every predetermined hull speed range (for example, for every 5 km/h). In the present preferred embodiment, as the suppression control map, a map that defines the relationship between the propeller rpm PN and the engine torque TRK is used. The suppression control map is stored in the ROM 32.

As a representative, the suppression control map corresponding to a ship speed V1 (for example, 50 km/h) will be described. Straight lines L1 and L2 are both set so that the engine torque TRK increases in proportion to the increase in the propeller rpm PN. The straight line L1 (first information) is used as a threshold value for determining whether ventilation has occurred. When the relationship between the propeller rpm PN and the engine torque TRK belongs to the lower right region with respect to the straight line L1 (region in which the high rotation and low torque), it is determined that ventilation is occurring. The straight line L2 (second information) is used as a threshold value in a restoration control which is performed when ventilation occurs and then is eliminated, wherein in the restoration control the opening adjustment unit 26 is controlled so that a throttle opening gradually transitions to a throttle opening corresponding to the operational position of the throttle lever 12. The straight line L2 shifts toward the low rpm with a certain margin with respect to the straight line L1. That is, at one ship speed V, the engine torque TRK defined on the straight line L2 is set higher than that on the straight line L1 when the propeller rpms PN are the same. The upper left region with respect to the straight line L2 (region in which the low rotation and high torque) is a region where ventilation surely does not occur. In other words, the straight line L2 defines a critical index by which the propeller 28 can firmly grasp the water.

The suppression control maps for every hull speed range have the following relationships. In both straight lines L1 and L2, the higher the hull speed, the lower the engine torque TRK is set at the same propeller rpm PN. Specifically, both the straight lines L1 and L2 are shifted in the lower rotation direction (left) as the hull speed is lower. For example, focusing on the straight lines L1, the value of the propeller rpm PN corresponding to the engine torque TRK with zero (TRK=0) in the suppression control map for the ship speed V2 (for example, 45 km/h) is lower than that in the suppression control map for the ship speed V1. The value of the propeller rpm PN corresponding to the engine torque TRK with zero in the suppression control map for the ship speed V3 (for example, 40 km/h) is further lower. This is because in the range below a certain ship speed, ventilation is more likely to occur as the hull speed is lower.

Figure 5:
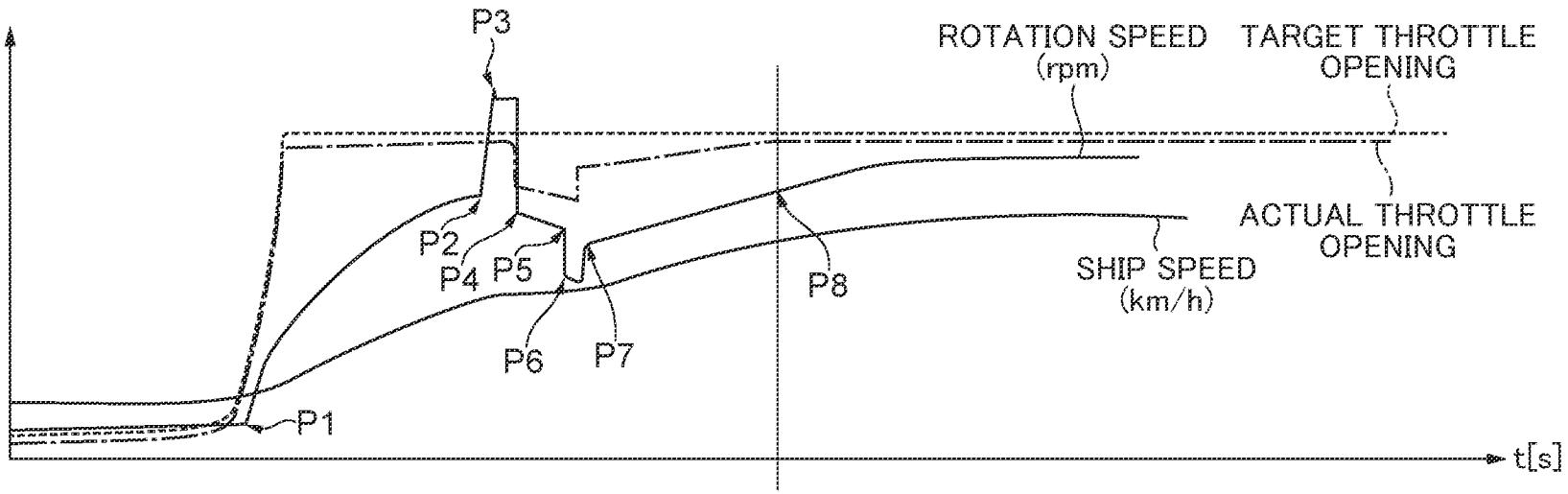
FIG. 5 is a diagram showing a transition of each parameter when a sudden acceleration operation is performed.

FIG. 5 is a diagram showing a transition of each parameter when a sudden acceleration operation is performed. The horizontal axis of the graph shows elapsed time t(s). The vertical axis shows the ship speed V, the propeller rpm PN (rpm), the actual throttle opening, and the target throttle opening. The actual throttle opening is an actual opening of the throttle detected by the throttle opening sensor 34. The target throttle opening is an opening of the throttle corresponding to the operational position of the throttle lever 12. In this example, a case where ventilation has occurred as a result of the vessel operator operating the throttle lever 12 so as to suddenly open the throttle (so as to suddenly enlarge the throttle opening) with the intention of sudden acceleration, is shown. It is assumed that the vessel operator keeps the operational position of the throttle lever 12 as it is even after ventilation has occurred.

The transition of each parameter will be described with reference to FIGS. 4 and 5. In FIGS. 4 and 5, the engine rpm N may be used instead of the propeller rpm PN. In FIG. 4, the transition of the relationship between the propeller rpm PN and the engine torque TRK is shown as phases P1 to P8. Also in FIG. 5, the phases P1 to P8 are shown. Since the ship speed V changes every moment, the suppression control map (FIG. 4) corresponding to the hull speed range to which the ship speed V at that time belongs is used. Therefore, as the ship speed V changes, the CPU 31 changes the suppression control map that it refers to, every moment. However, here, for convenience, the ventilation suppression control will be described with reference to only the suppression control map corresponding to the ship speed V1.

First, starting from the phase P1, when the target throttle opening increases, the actual throttle opening also increases. Along with that, the propeller rpm PN also increases while the propeller 28 paddling the water, and the ship speed V also gradually increases. When ventilation occurs in the phase P2, the propeller rpm PN sharply increases and the engine torque TRK sharply decreases (FIG. 4), and a phase shifts to the phase P3. The CPU 31 determines that ventilation has occurred when the relationship between the propeller rpm PN and the engine torque TRK shifts to the lower right region with respect to the straight line L1. That is, when the engine torque TRK becomes lower than an engine torque defined by the straight line L1 with respect to the propeller rpm PN, the CPU 31 determines that the ventilation has occurred. When the ventilation occurs, the CPU 31 starts ventilation suppression control. The degree of increase of the ship speed V is weakened or decreased. When the ship speed V changes, the suppression control map used in the ventilation suppression control also changes in stages.

First, the CPU 31 controls the opening adjustment unit 26 so that the actual throttle opening is decreased by the first predetermined amount (FIG. 5). As a result, the propeller rpm PN and the engine torque TRK sharply decrease (FIG. 4), and the phase shifts to the phase P4. The first predetermined amount is preset according to the ship speed. When the phase shifts to the phase P4, the CPU 31 controls the opening adjustment unit 26 so that the actual throttle opening is decreased by a minute amount smaller than the first predetermined amount. The CPU 31 performs the operation to decrease the actual throttle opening by the minute amount at regular time intervals until it is determined that the propeller 28 has grabbed the water. When the relationship between the propeller rpm PN and the engine torque TRK belongs to the upper left region with respect to the straight line L2, the CPU 31 determines that the propeller 28 has grabbed water (phase P5).

When the phase shifts to the phase P5 and the propeller 28 grabs the water, the propeller rpm PN decreases sharply and the engine torque TRK increases sharply (FIG. 4), and the phase shifts to the phase P6. At this time, the ventilation has been eliminated, but the actual throttle opening may be significantly away from the target throttle opening. Therefore, the CPU 31 controls the opening adjustment unit 26 so that the actual throttle opening is increased by the second predetermined amount. By this control, the propeller rpm PN and the engine torque TRK sharply increase (FIG. 4), and the phase shifts to the phase P7. The second predetermined amount is preset according to the ship speed within a range in which ventilation does not occur.

When the phase shifts to the phase P7, the CPU 31 controls the opening adjustment unit 26 so that the actual throttle opening is increased by a minute amount smaller than the second predetermined amount. The CPU 31 performs the operation to increase the actual throttle opening by the minute amount at regular time intervals until the actual throttle opening matches the target throttle opening. Therefore, the actual throttle opening gradually transitions to the target throttle opening. When the actual throttle opening matches the target throttle opening (phase P8), the CPU 31 ends the ventilation suppression control. This ventilation suppression control will be described with reference to the flowchart of FIG. 6.

Figure 6:
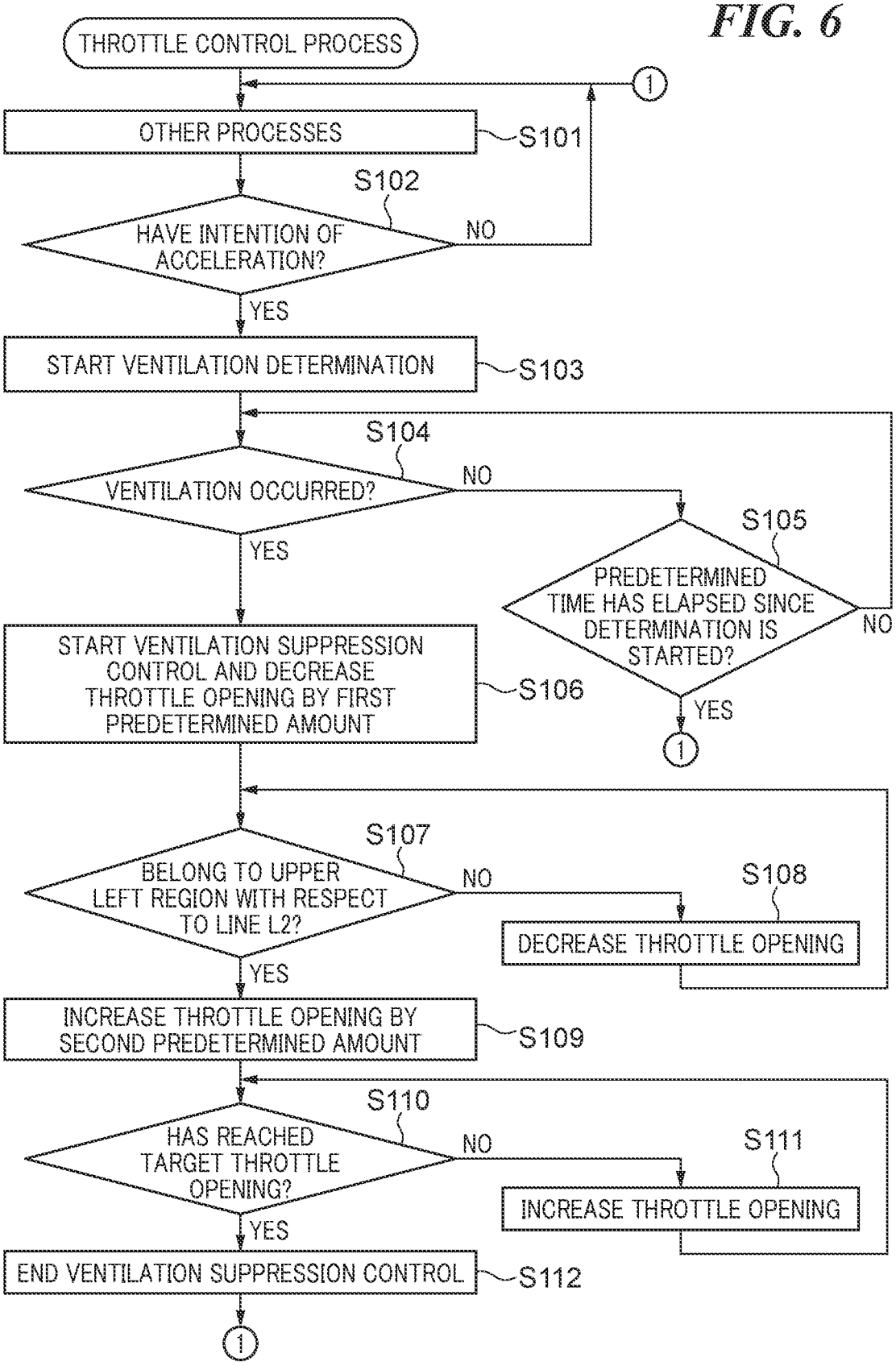
FIG. 6 is a flowchart of a throttle control process.

FIG. 6 is a flowchart of the throttle control process. This processing is realized by the CPU 31 expanding the control program stored in the ROM 32 into the RAM 33 and executing the control program. The vessel operator can set whether to activate the ventilation suppression control that is automatically performed. For example, the vessel operator can set permission or prohibition of activation of the ventilation suppression control by the setting operation unit 19. This process is started in a case where the marine vessel maneuvering system is activated and the activation of the ventilation suppression control is permitted. In a case where the activation of ventilation suppression control is prohibited, the normal throttle control process is performed. In the processing of FIG. 6, the CPU 31 performs acquisition of various pieces of information/values, various determinations, and various types of control.

In step S101, the CPU 31 performs other processes. In the "other processes" referred to here, for example, various types of processes are performed in accordance with the setting and/or operation by the vessel operator via the setting operation unit 19. In a case where prohibition of the activation of the ventilation suppression control is instructed by the vessel operator via the setting operation unit 19, this processing is ended and the normal throttle control process is performed. Further, when there is an instruction to shut down the marine vessel maneuvering system, a process of ending this processing is performed.

In step S102, the CPU 31 determines whether there is an intention of acceleration so as to determine whether ventilation occurs in a situation where ventilation is likely to occur. Here, the CPU 31 determines whether there is an intention of acceleration based on the operation on the throttle lever 12 detected by the throttle sensor 25. For example, the CPU 31 determines that there is an intention of acceleration when the operation speed of the throttle lever 12 is equal to or higher than a first predetermined value. The operation speed is acquired from the change in the operational position of the throttle lever 12 within a certain time. Further, when the degree of change in the operation speed of the throttle lever 12 is equal to or higher than a second predetermined value, the CPU 31 determines that there is an intention of acceleration. The intention of acceleration may be comprehensively determined by both the operation speed and the degree of change in the operation speed. Further, the way to determine whether there is an intention of acceleration is not limited to these examples.

Then, when not determining that there is an intention of acceleration, the CPU 31 returns the process to step S101. When determining that there is an intention of acceleration, the CPU 31 starts, in step S103, determining whether ventilation has occurred. As described above, the CPU 31 determines whether ventilation has occurred based on whether the relationship between the propeller rpm PN and the engine torque TRK belongs to the lower right region with respect to the straight line L1 (FIG. 4) corresponding to the current ship speed V.

In step S104, the CPU 31 determines whether ventilation has occurred. When not determining that ventilation has occurred the CPU 31 determines, in step S105, whether a predetermined time has elapsed since the start of the determination of whether ventilation has occurred. When the predetermined time has not elapsed since the start of the determination of whether ventilation has occurred, the CPU 31 continues the determination of whether ventilation has occurred in step S104. When the predetermined time has elapsed without determining that ventilation has occurred, it can be determined that ventilation due to the current acceleration did not occur, and the CPU 31 therefore returns the process to step S101. Whereas, when determining that ventilation has occurred before the elapse of the predetermined time (P2), the CPU 31 proceeds the process to step S106.

In step S106, the CPU 31 starts ventilation suppression control (P3). First, the CPU 31 controls the opening adjustment unit 26 so that the actual throttle opening is decreased by the first predetermined amount. As a result, the propeller rpm PN and the engine torque TRK sharply decrease (P4). In step S107, the CPU 31 determines whether the relationship between the propeller rpm PN and the engine torque TRK got to belong to the upper left region with respect to the straight line L2 (FIG. 4) (that is, whether in FIG. 4, the phase transited toward the upper left while crossing the straight line L2). When the relationship between the propeller rpm PN and the engine torque TRK does not belong to the upper left region with respect to the straight line L2, in step S108, the CPU 31 controls the opening adjustment unit 26 so that the actual throttle opening is decreased by a minute amount smaller than the first predetermined amount. Then, after waiting for the elapse of a certain time, the CPU 31 returns the process to step S107. After a while, the propeller 28 starts to grab water, and when the relationship between the propeller rpm PN and the engine torque TRK gets to belong to the upper left region with respect to the straight line L2 (P5, P6), the CPU 31 proceeds the process to step S109. In this case, the CPU 31 determines that the ventilation has been eliminated.

In step S109, the CPU 31 controls the opening adjustment unit 26 so that the actual throttle opening is increased by the second predetermined amount. By this control, the propeller rpm PN and the engine torque TRK rapidly increase (P7). In step S110, the CPU 31 determines whether the actual throttle opening matches the target throttle opening (that is, whether the target throttle opening is reached). When the actual throttle opening does not match the target throttle opening, in step S111, the CPU 31 controls the opening adjustment unit 26 so that the actual throttle opening is increased by the minute amount smaller than the second predetermined amount. Then, after waiting for the elapse of a certain time, the CPU 31 returns the process to step S110. The repetition of steps S110 and S111 corresponds to the restoration control in which the actual throttle opening transitions to the target throttle opening. After a while, the actual throttle opening eventually matches the target throttle opening (P8), then the CPU 31 ends the ventilation suppression control (step S112). After that, the CPU 31 returns the process to step S101.

In the process of FIG. 6, the CPU 31 may perform a notification process for notifying the vessel operator of the status of the hull and the control status at each process. The notification process is performed with a screen display or a voice. For example, the CPU 31 may make a notification of the state of permission/prohibition of activation of the ventilation suppression control. Further, the CPU 31 may make a notification of the start/end of the ventilation suppression control. Further, the CPU 31 may make a notification that it has been determined that ventilation has occurred/eliminated.

According to this preferred embodiment, the CPU 31 determines whether ventilation has occurred based on the propeller rpm PN (or the engine rpm N), the engine torque TRK, and the ship speed V. As a result, it is possible to more accurately determine whether ventilation has occurred, as compared with the conventional technique of performing the determination from the target rotation and the actual rotation of the engine.

The CPU 31 may determine whether ventilation has occurred based on at least two of the propeller rpm PN (or the engine rpm N), the engine torque TRK, and the ship speed V. For example, when the engine torque decreases even though the throttle opening is increased, the CPU 31 may determine that ventilation has occurred regardless of the ship speed.

In addition, when determining that ventilation has occurred, the CPU 31 decreases the throttle opening by the first predetermined amount (P3→P2 to P4), which enables the ventilation to come to an end quickly.

Further, the CPU 31 uses the suppression control map corresponding to the hull speed range to which the ship speed V belongs, and uses the straight line L1 as the determination threshold value, to determine whether ventilation has occurred, which makes it easy to perform the process.

In the restoration control, the CPU 31 uses the straight line L2 of the suppression control map as a determination threshold value to perform control so that the actual throttle opening is transitioned to the target throttle opening, which makes it possible, after the ventilation is eliminated, to returns the throttle opening to the throttle opening intended by the vessel operator.

Further, when determining that there is an intention of acceleration based on that the throttle lever 12 being operated, the CPU 31 starts determining whether ventilation has occurred. As a result, the CPU 31 starts the determination on the condition that the hull 13 became in a state where ventilation is likely to occur, which avoids the unnecessary process.

It should be noted that as the first and second information defining the relationship between the rpm of the engine or the propeller and the engine torque for every predetermined hull speed range, the straight lines L1 and L2 of the suppression control map (FIG. 4) are exemplified, but the first and second information is not limited to these. The first and second information may be acquired by a function or an arithmetic expression. Other than these, for example, a map in which the relationship between the rpm and the engine torque is defined as a curve may be used as the first or second information. Alternatively, the first or second information may be acquired by using a map consisting of a plurality of points plotted showing the relationship between the rpm and engine torque, a table that defines the correspondence between the rpm and the engine torque, and the like. In these cases, a value in a range where there is no plot or corresponding value may be acquired by interpolation processing or the like.

It should be noted that the number of outboard motors may be two or more. Further, the marine vessel to which the present invention is applied is not limited to a marine vessel equipped with an outboard motor, but may be a marine vessel equipped with other types of marine propulsion device such as an inboard/outboard motor (sterndrive or inboard motor/outboard drive) or an inboard motor, and a water jet drive.

The present invention is not limited to the specific embodiment described above, and various forms within the gist of the present invention are also included in the present invention.

While a preferred embodiment of the present invention has been described above, it is to be understood that variations and modifications will be apparent to those skilled in the art without departing from the scope and spirit of the present invention. The scope of the present invention, therefore, is to be determined solely by the following claims.

What is claimed is:

1. A control device of a marine propulsion device that has an engine and a propeller and is mountable on a hull, the control device comprising:

a processor, and a non-transitory storage medium having program instructions stored thereon, execution of which by the processor causes the control device to acquire a rotation speed of the engine or a rotation speed of the propeller, acquire a torque of the engine, acquire a speed of the hull, and determine whether a ventilation of the engine has occurred based on at least two among the acquired rotation speed, the acquired engine torque, and the acquired hull speed.

2. The control device of the marine propulsion device according to claim 1, wherein the execution of the program instructions by the processor further causes the control device to refer to first information, which defines a first relationship between a rotation speed of the engine or the propeller and an engine torque, for each of a plurality of predetermined hull speed ranges, and determine whether the ventilation has occurred by using values of the rotation speed and the engine torque in the first information that correspond to one of the plurality of predetermined hull speed ranges to which the acquired hull speed belongs.

3. The control device of the marine propulsion device according to claim 2, wherein in the first information, the higher is the predetermined hull speed range, the lower is the engine torque for a same rotation speed, and when the acquired engine torque at the acquired rotation speed is lower than a value of the engine torque defined in the first information at the acquired rotation speed, the controller determines that the ventilation has occurred.

4. The control device of a marine propulsion device according to claim 2, further comprising:

an opening adjustment device configured to adjust a throttle opening of the engine, wherein upon determining that the ventilation has occurred, the controller controls the opening adjustment device to decrease the throttle opening by a first predetermined amount.

5. The control device of the marine propulsion device according to claim 4, wherein the controller, after controlling the opening adjustment device to decrease the throttle opening by the first predetermined amount, refers to second information, which defines a second relationship between a rotation speed of the engine or the propeller and an engine torque, for each of the plurality of predetermined hull speed ranges, and performs restoration control to control the opening adjustment device, to thereby transition the throttle opening to correspond to an operational position of a throttle operator that manually adjusts the throttle opening, by using values of the rotation speed and the engine torque in the second information that correspond to the one hull speed range to which the acquired hull speed belongs.

6. The control device of the marine propulsion device according to claim 5, wherein for the second information, the higher is the predetermined hull speed range, the lower is the engine torque for a same rotation speed, for a same predetermined hull speed range and a same rotation speed, the engine torque in the second information has a higher value than the engine torque in the first information, and the controller controls the opening adjustment device until the acquired engine torque at the acquired rotation speed is higher than a value of the engine torque defined in the second information at the acquired rotation speed, and subsequently performs the restoration control to control the opening adjustment device to increase the throttle opening by a second predetermined amount.

7. The control device of the marine propulsion device according to claim 6, wherein at the restoration control, the controller, after controlling the opening adjustment device to increase the throttle opening by the second predetermined amount, subsequently controls the opening adjustment device to further increase the throttle opening until the throttle opening corresponds to the operational position of the throttle operator.

8. The control device of the marine propulsion device according to claim 1, further comprising:

an opening adjustment device configured to adjust a throttle opening of the engine, wherein upon determining that the ventilation has occurred, the controller controls the opening adjustment device to decrease the throttle opening.

9. The control device of the marine propulsion device according to claim 1, wherein the controller determines, based on an operation on a throttle operator for manually adjusting a throttle opening of the engine, whether there is an intention of acceleration, and upon determining that there is the intention of acceleration, starts determining whether the ventilation has occurred.

10. A method of controlling a marine propulsion device that has an engine and a propeller and is mountable on a hull, the control method comprising:

acquiring a rotation speed of the engine or a rotation speed of the propeller;

acquiring a torque of the engine;

acquiring a speed of the hull; and determining whether a ventilation of the engine has occurred based on at least two among the acquired rotation speed, the acquired engine torque, and the acquired hull speed.

11. A marine vessel, comprising:

a marine propulsion device that has an engine and a propeller, and is mounted on a hull of the marine vessel; and a control device that includes a processor, and a non-transitory storage medium having program instructions stored thereon, execution of which by the processor causes the control device to acquire a rotation speed of the engine or a rotation speed of the propeller, acquire a torque of the engine, acquire a speed of the hull, and determine whether a ventilation of the engine has occurred based on at least two among the acquired rotation speed, the acquired engine torque, and the acquired hull speed.

* * * * *